US006332252B1

(12) United States Patent
Powers

(10) Patent No.: US 6,332,252 B1
(45) Date of Patent: Dec. 25, 2001

(54) RELEASE RESISTANT BUCKLE COVER

(76) Inventor: Diana L. Powers, P.O. Box 78, Lincoln, MA (US) 01773

( * ) Notice: Subject to any disclaimer, the term of this patent is extended or adjusted under 35 U.S.C. 154(b) by 0 days.

(21) Appl. No.: 09/484,091

(22) Filed: Jan. 18, 2000

Related U.S. Application Data

(60) Provisional application No. 60/116,262, filed on Jan. 19, 1999.

(51) Int. Cl.[7] ..... A44B 11/26
(52) U.S. Cl. ..... 24/633; 24/634
(58) Field of Search ..... 24/633, 634; 297/482

(56) References Cited

U.S. PATENT DOCUMENTS

| | | | |
|---|---|---|---|
| 4,497,094 | 2/1985 | Morris | 24/633 |
| 4,502,194 | 3/1985 | Morris et al. | 24/633 |
| 4,674,303 | 6/1987 | Salcone | 70/63 |
| 4,731,912 * | 3/1988 | Boriskie et al. | 24/633 |
| 4,878,277 * | 11/1989 | Portuese | 24/633 |
| 5,307,544 | 5/1994 | Quarberg et al. | 24/633 |
| 5,415,333 * | 5/1995 | Wills | 224/328 |
| 5,416,957 * | 5/1995 | Renzi, Sr. et al. | 24/633 |

FOREIGN PATENT DOCUMENTS

| | | | |
|---|---|---|---|
| 2307505 * | 5/1997 | (GB) | 24/633 |

* cited by examiner

*Primary Examiner*—Victor N. Sakran
(74) *Attorney, Agent, or Firm*—Ronald R. Kilponen

(57) ABSTRACT

A release resistant buckle cover is shown having a primarily rectangular shape for engagement with a top release female buckle portion of a seat belt. A plurality of gaps are provided to provide passage of the male belt to the female buckle for engagement of the seat belt. The gaps are also used to provide passage of a thin object such as a key to be inserted through one of the gaps to compress the top release button of the female buckle to release the male belt thus disengaging the seat belt.

4 Claims, 3 Drawing Sheets

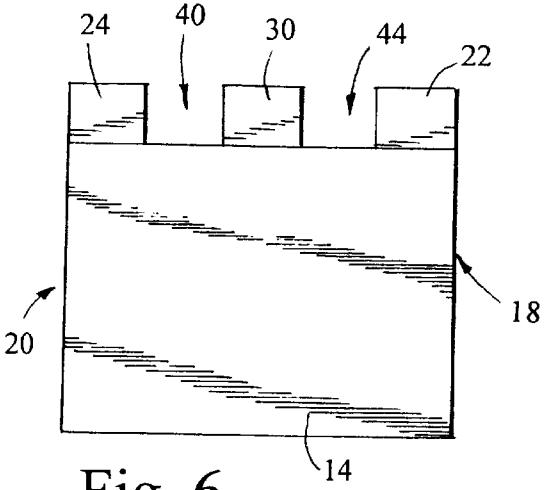
Fig. 6
Fig. 5
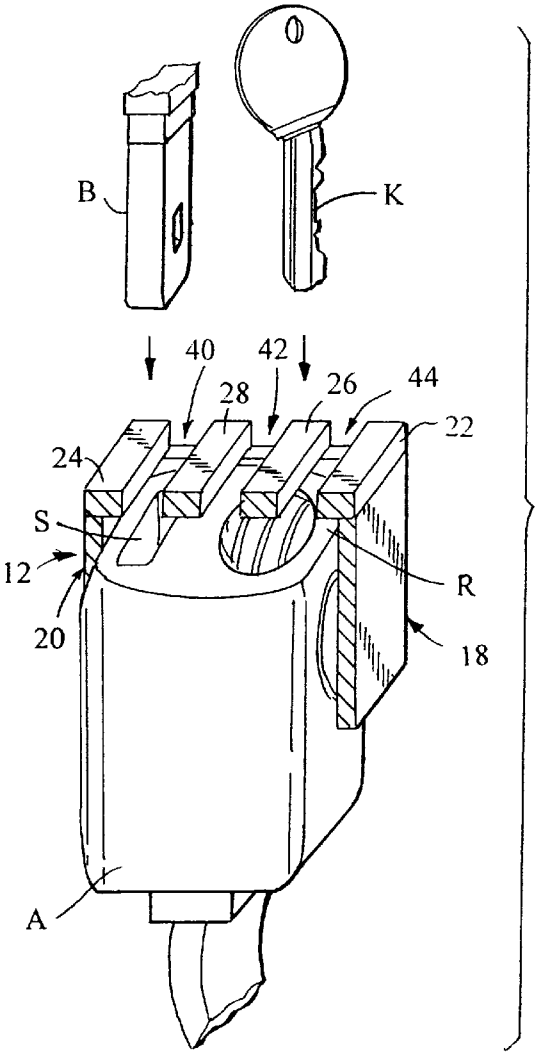

RELEASE RESISTANT BUCKLE COVER

CROSS REFERENCE TO RELATED APPLICATIONS

This application claims the benefit of US provisional patent application number 60/116,262 filed, Jan. 19, 1999.

BACKGROUND

This invention relates to a device for keeping a seat belt buckled such that it cannot be released prematurely by a rider.

Seat belts save lives. Most persons wear seat belts and many states have enacted seat belt laws. Many laws require infant seats and child seats for persons below a specific weight. This device can be used with a seat belt alone or in combination with car seats, booster seats or harnesses used to retain passengers in a vehicle.

The problem addressed is that the belts can be released by bored or curious children or handicapped children and adults. The caretakers may not realize that the seat belt is unbuckled and this could increase the seriousness of injuries if involved in an accident. In the case of handicapped children or adults, the rider is coordinated enough many times to release the belt themselves, but not cognizant of the dangers of releasing the seat belt while riding in a moving vehicle. Other times, the riders may release the seat belt and amble about the moving vehicle or cause harm to other passengers, or interfere with the driver.

It is a serious problem when riders can release the seat belts themselves at inappropriate times. If the driver even notices the belt is released they must then stop the vehicle and reattach the belt. This is inconvenient at the least and can require stopping on a busy street or highway posing a hazard to the person who exits the car, if necessary, to reattach the seat belt. If there is another assistant or adult, they must unfasten their belt and lean over the seat or walk back to re-attach the released belt. This is inconvenient, dangerous and time consuming.

When the belt is re-attached, the rider will many times release the belt again requiring attention, to once again re-attach the belt.

Several devices in the art have addressed this issue of retaining the seat belt in the attached position. Many of the newer vehicle seat belts, seat belt recalls and retrofits have the release button on the top of the buckle. The embodiments disclosed are particularly effective for top release seat belt buckles. A user could use the device in multiple vehicles or while traveling on vacations in friends or rental vehicles and still deter the release of top release buckles.

Therefore, if a rider is traveling in a newer vehicle and coordinated enough to release the buckle this many times occurs with no known acceptable cost effective solution.

For the foregoing reasons, there is a need for a Release Resistant Buckle Cover that will inhibit the release of the seat belt on belts with the release button on the top of the buckle.

In view of the foregoing disadvantages inherent in the prior art, there is a need for a device that will prevent a rider from releasing the seat belt of a top release belt buckle.

OBJECTS OF INVENTION

A first object of the present invention is to provide a device that will inhibit the untimely release of top release button seat belts.

A second object of the present invention is to provide a device to discourage the untimely release of top release button seat belts.

Another object of the present invention is to provide a device that is not unduly complicated, but discourages the untimely release of the seat belt.

An additional object of the present invention is to provide a device to discourage the release of top release button seat belts that is reasonably priced.

Another object of the present invention is to provide a device that is relatively easy to manufacture.

It is yet another object of the present invention is to provide a device that will function with the majority of the top release button seat belts.

Another object of the present invention is to provide a device that is esthetically appealing.

It is yet another object of the present invention to provide a device that can be manufactured from readily available materials.

It is a still further object of the present invention to provide a device that does not require an inordinate amount of time to attach and release from the buckle.

It is an additional object of the present invention to provide a device that is unlikely to wear out.

It is another object of the present invention to provide a device that can readily be removed by rescue workers if the vehicle is involved in an accident.

It is an additional object of the present invention to provide a device that does not interfere with the safe operation of the seat belts.

It is a final object of the present invention to provide a device that is easily stored if removed from the seat belt buckle.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

BRIEF DESCRIPTION OF DRAWINGS

FIG. 5 shows a cutaway side view of one embodiment of the present invention with a female buckle portion, male belt portion and release key.

FIG. 6 shows an end view of a second embodiment of the present invention.

DETAILED DESCRIPTION OF THE PREFERRED EMBODIMENTS

Figure 1:
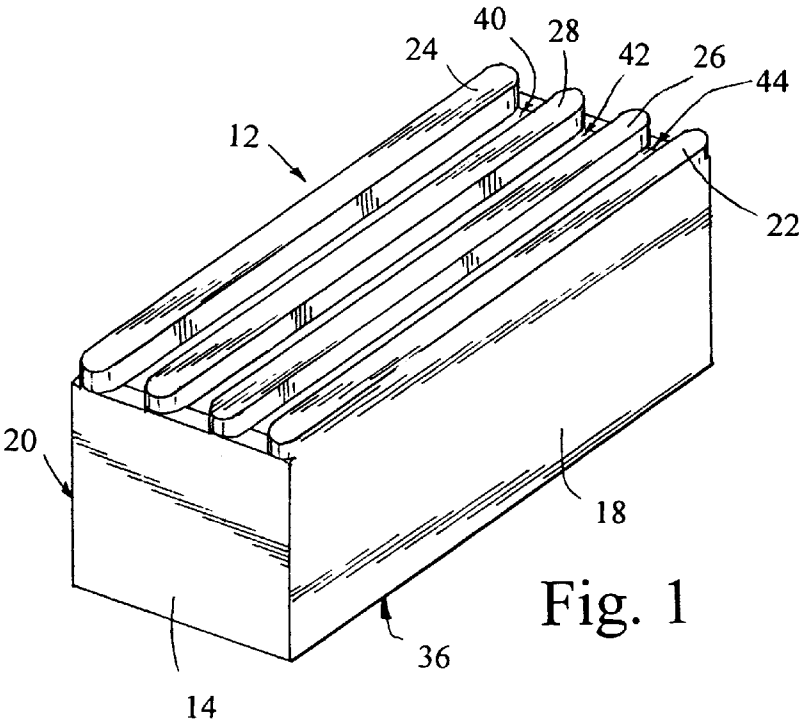
FIG. 1 shows a perspective view of one embodiment of the present invention.

Referring to the drawings in detail wherein like elements are indicated by like numerals, there is shown in FIG. 1 a perspective view of the release resistant buckle cover 12.

Figure 2:
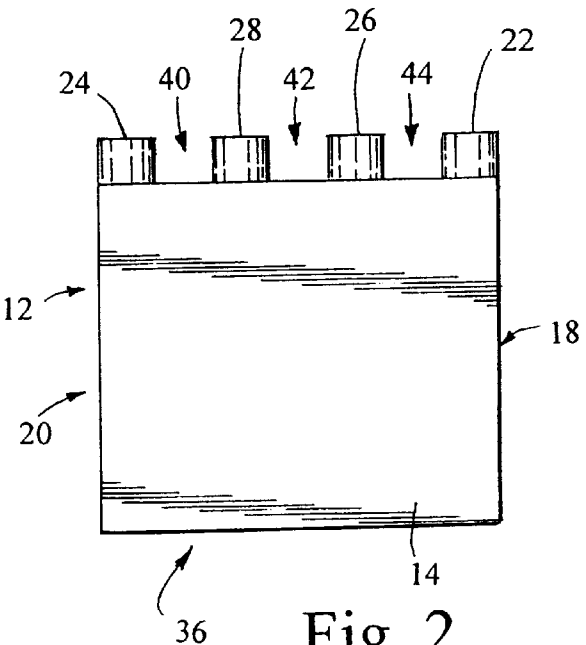
FIG. 2 shows an end view of one embodiment of the present invention.

The buckle cover 12 is primarily rectangular in shape having an open or hollowed out central portion 36, FIG. 2, for surrounding a female buckle A, FIG. 5. While this embodiment shows a buckle cover 12 having an approximately rectangular configuration, the buckle cover 12 could be custom fit to a particular model or company shape of female buckle A and therefore could take on other configurations matching the female buckle A, such as round or oblong or oval and others.

The buckle cover 12 has a first end wall 14 opposite a second end wall 16 joined to first and second side walls 18, 20, FIG. 1. The bottom of the rectangle has no wall, or is open, while the top of the rectangle has a plurality of ridges and gaps. In a preferred embodiment, the buckle cover 12 is injection molded from a polymer which is relatively unaffected by temperature extremes and UV rays.

This particular embodiment shows a first side ridge 22 extending from the first side wall 18, FIG. 2. Adjacent the first side ridge 22 is the third gap 44 which allows passage of objects from above the buckle cover 12 into the central portion 36 of the buckle cover 12. Likewise, adjacent third gap 44 is the first middle ridge 26 which is adjacent to the second gap 42, which is adjacent to the second middle ridge 28, which is adjacent to the first gap 40 and ending with the second side ridge 24, FIG. 2. Basically, the top surface is alternating ridges and gaps. While this embodiment shows four ridges and three gaps, it is to be understood that fewer ridges could be used as long as there were more than 2 ridges. Likewise, other embodiments could utilize two or more gaps and related ridges. This embodiment in FIG. 2 shows the ridges 22, 24, 26 & 28 having a rectangular cross section. A rounded, triangular or other shape cross section of the ridges may be feasible. A taper on the ridges may be helpful in addressing manufacturing concerns. Other configurations of the ridges are to be included in the scope of this disclosure such as a zig-zag pattern or special hole pattern and arrangement of the ridges.

The side walls 18, 20 of the buckle cover 12, should be large enough such that a female buckle A, as shown in FIG. 5, can be mostly contained within the central portion 36 of the buckle cover 12. The buckle cover 12 should cover the female buckle A such that no access to the release button R could be obtained except through one of the gaps 40, 42, or 44.

FIG. 5 shows the buckle cover 12 covering the female buckle A having a slot S and a release button R. This embodiment shows that the male belt B inserted through first gap 40 to engage within slot S. This secures the male belt B and female buckle A together such that they cannot be easily accidently released.

To release the male belt B from the female buckle A requires one to insert a key K or any other similar object into one of the gaps 40, 42, 44. In this configuration, the user would insert key K into either second gap 42 or third gap 44 to engage the release button R and by pushing the release button R releasing the male belt B from the female buckle A.

The gaps are sized such that only key sized objects will fit where a childs finger or larger adults finger would not be able to disengage the seat belt.

Figure 4:
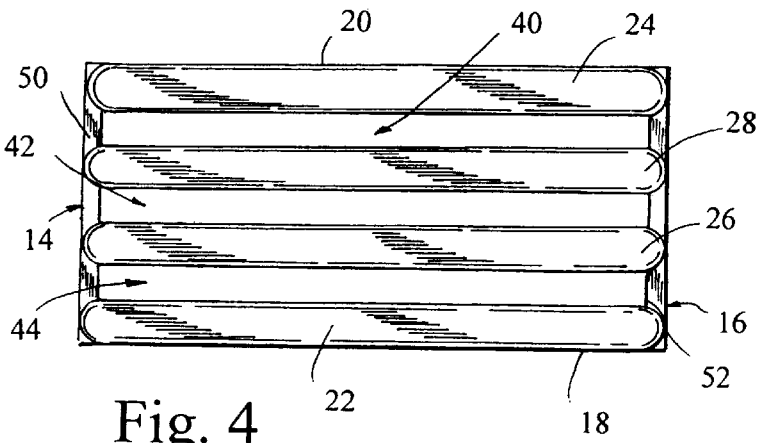
FIG. 4 shows is a top view of one embodiment of the present invention.
Figure 3:
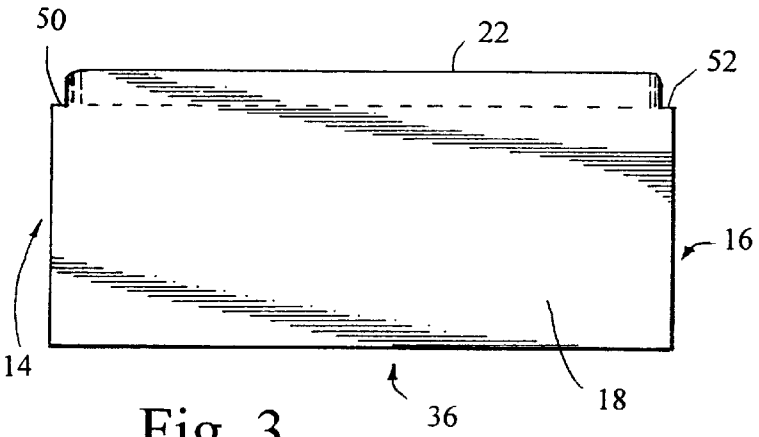
FIG. 3 shows a side view of one embodiment of the present invention.

FIG. 3 shows a side view of the buckle cover 12 having a first ledge 50 above the first end wall 14 and a second ledge 52 above the second end wall 16. The first ledge 50 and second ledge 52 extend between the ridges 22, 24, 26 along the top of the first end wall 14 and the second end wall 16, FIG. 3 & FIG. 4. These ledges 50, 52 are important in that they allow the male belt B, FIG. 5, to fully engage the female buckle A. If the buckle cover 12 were merely a box with slots, without ledges 50, 52, there would not be enough thickness and strength to the ridges 22, 24, 26 to allow the male belt B to fully engage the female buckle A. In other words, in order to have a operational thickness to the ridges 22, 24, 26 does not allow the male belt B to get close enough to engage the female buckle A. The ledges 50, 52 allow the male belt B to get closer to the female buckle A such that they can fully engage. FIG. 4 shows a top view of the ridges 22, 24, 26 and 28 and gaps 40, 42 44.

FIG. 6 shows a second embodiment having a first side ridge 22, center ridge 30 and second side ridge 24 having a first gap 40 and third gap 44. While this embodiment would be functional on most top release seat belts, having only one gap in which to insert the male belt B (not shown) or key K (not shown) could result in greater difficulties in releasing the belt or attaching the belt if the first gap 40 and third gap 44 did not align with the slot S and release button R (neither shown).

It will now be apparent to those skilled in the art that other embodiments, improvements, details and uses can be made consistent with the letter and spirit of the foregoing disclosure and within the scope of this patent, which is limited only by the following claims, construed in accordance with the patent law including the doctrine of equivalents.

What is claimed is:

1. A device for use with a seat belt, the seat belt having a male belt and a female buckle with a top release button, the device comprising:

a buckle cover having a first end wall opposite a second end wall, said first end wall and said second end wall connected by a first side wall and a second side wall both longer than the end walls;

said first and second end walls having a plurality of ridges interconnecting the end walls, said plurality of ridges having a corresponding number of gaps allowing access to an open central portion of the buckle cover;

the buckle cover for engaging the female buckle with the top release button, said female buckle contained mostly within the central portion of the buckle cover;

one gap sized to allow partial passage of the male belt there through for engagement with the female buckle; and the remaining gaps sized to not allow access to the release button by a finger.

2. The device of claim 1, wherein:

the buckle cover has four ridges and three gaps.

3. The device of claim 1, wherein:

said first end wall, said second end wall and said first side wall and said second side wall form an approximately rectangular shape.

4. A device for use with a seat belt, the seat belt having a male belt and a female buckle with a top release button, the device comprising:

a buckle cover having a first end wall opposite a second end wall, said first end wall and said second end wall connected by a first side wall and a second side wall both longer than the end walls;

said first and second end walls having a plurality of ridges interconnecting the end walls, said plurality of ridges having a corresponding number of gaps allowing access to an open central portion of the buckle cover;

the buckle cover for engaging the female buckle with the top release button, said female buckle contained mostly within the central portion of the buckle cover;

the buckle cover having four ridges and three gaps;

one gap sized to allow partial passage of the male belt there through for engagement with the female buckle;

the remaining gaps sized to not allow access to the release button by a finger; and said first end wall, said second end wall and said first side wall and said second side wall form an approximately rectangular shape.

* * * * *